US010074319B2

(12) United States Patent
Huitema

(10) Patent No.: US 10,074,319 B2
(45) Date of Patent: Sep. 11, 2018

(54) HIGH QUALITY IMAGE UPDATES IN BI-STABLE DISPLAYS

(71) Applicant: Polyera Corporation, Skokie, IL (US)

(72) Inventor: Hjalmar Edzer Ayco Huitema, Belmont, CA (US)

(73) Assignee: FLEXTERRA, INC., Skokie, IL (US)

( * ) Notice: Subject to any disclaimer, the term of this patent is extended or adjusted under 35 U.S.C. 154(b) by 115 days.

(21) Appl. No.: 15/351,420

(22) Filed: Nov. 14, 2016

(65) Prior Publication Data

US 2017/0236473 A1 Aug. 17, 2017

Related U.S. Application Data

(63) Continuation of application No. PCT/US2015/030254, filed on May 12, 2015.

(60) Provisional application No. 61/992,211, filed on May 12, 2014.

(51) Int. Cl.
*G09G 5/10* (2006.01)
*G09G 3/34* (2006.01)

(52) U.S. Cl.
CPC ..... *G09G 3/344* (2013.01); *G09G 2310/08* (2013.01); *G09G 2320/0285* (2013.01); *G09G 2340/16* (2013.01)

(58) Field of Classification Search
CPC ..... G09G 3/44; G09G 3/344; G09G 5/02
USPC ..... 345/55, 690; 359/292
See application file for complete search history.

(56) References Cited

U.S. PATENT DOCUMENTS

| | | | |
|---|---|---|---|
| 2006/0077127 | A1 | 4/2006 | Sampsell et al. |
| 2009/0267969 | A1 | 10/2009 | Sakamoto |
| 2011/0128266 | A1 | 6/2011 | Chiu et al. |
| 2013/0038622 | A1 | 2/2013 | Yang |
| 2013/0300779 | A1 | 11/2013 | Van Baarsen et al. |

OTHER PUBLICATIONS

International Search Report and Written Opinion for Application No. PCT/US2015/030254, dated Aug. 10, 2015.
International Preliminary Report on Patentability for Application No. PCT/US2015/030254, dated Nov. 15, 2016.

*Primary Examiner* — Calvin C Ma
(74) *Attorney, Agent, or Firm* — Marshall, Gerstein & Borun LLP

(57) ABSTRACT

A bi-stable electronic display driving technique drives an image refresh on a bi-stable electronic display, such as an electrophoretic display, using a driving integrated circuit with a single and limited in size image buffer, in a manner that does not require a simultaneous blanking or erasing of the display and in a manner that operates to drive the pixel elements of the display to their final value associated with the new image more quickly during an image refresh cycle. This technique results in an image refresh that is of higher quality and that is more pleasing to the eye while still using a driving integrated circuit with limited memory and processing power.

19 Claims, 2 Drawing Sheets

HIGH QUALITY IMAGE UPDATES IN BI-STABLE DISPLAYS

RELATED APPLICATIONS

This application is a continuation of International Application No. PCT/US2015/030254 filed on May 12, 2015, which claims priority to and the benefit of the filing date of U.S. Provisional Patent Application Ser. No. 61/992,211, entitled "High Quality Image Updates in Bi-Stable Displays" which was filed on May 12, 2014, the entire disclosure of which is hereby expressly incorporated by reference herein.

TECHNICAL FIELD

This application relates generally to bi-stable displays, such as electrophoretic displays, and more particularly to a method for providing high quality image updates in bi-stable displays with fast update times and limited memory usage.

BACKGROUND

Bi-stable displays, such as electrophoretic displays (EPDs), typically operate to produce an image using a field or array of pixels, wherein each pixel has a reflection state that is either black (a least reflective state) or white (a most reflective state) or some reflective state in-between these two extremes (a gray level state). Bi-stable displays having pixel elements that can take on more than two states (gray levels) typically use a number of reflective states that is a power of two, e.g., four, eight, sixteen, etc. During operation, the pixel elements of bi-stable displays, such as EPDs, are driven to a new reflection state by the combination of the voltage applied to a set of transistor electrodes associated with the pixel elements and time. In particular, the reflection state of a pixel element of an EPD is not able to change instantaneously because the reflection state of the pixel element is based on the position of a reflective material (e.g., a microcapsule) within an electromagnetic field or between two electrically charged electrodes, which position changes relatively slowly (non-instantaneously) over time in response to a change in a voltage differential being applied between the two electrodes. Thus, the reflective state (DR) of an EPD pixel element is a function of the voltage (V) between the pixel electrodes and the derivative of time (Dt) in the form of $DR=V\times Dt$.

In order to refresh an EPD or other bi-stable display from a first image to a second image, each of the pixel elements of the display is driven from a first reflection state (associated with the first image) to a second reflection state (associated with the second image) over an image refresh time, also referred to as an image refresh cycle, typically on the order of 600 milliseconds. Each image refresh cycle is made up of a number of (e.g., 30) frame times or frame cycles (also called frame scans) during which each pixel element of the display is or can be provided a new voltage level. More particularly, the frame time is a measure of the amount of time that it takes to change the voltage at every pixel element of the display, and is thus the time it takes to scan all of the rows (i.e., gates) of the display once. The frame time for typical EPDs is 20 ms (corresponding to a scan rate of 50 Hz).

Generally speaking, during each frame cycle, a display driver turns each row of pixel elements of a display on, in sequence, by providing (via a gate line associated with a row of pixel elements) a turn-on voltage to the gate electrodes of the transistors associated the pixel elements in that row. At this time, the display driver also sets the voltage at the source electrode of each of the transistors within the row of pixel elements to a new voltage state via a set of source lines. The display driver cycles through all of the rows of pixel elements once in series during each frame scan thereby providing a controlled voltage to each pixel element. When an image refresh cycle is made up of 30 frame cycles, the voltage at each pixel element can be changed 30 times over the course of driving the pixel element from one reflection state to another reflection state within a single image refresh cycle.

The manner in which the voltage state or voltage level provided at the source electrode of each pixel element is changed between the different scans within an image refresh cycle is based on a recipe that defines the voltage levels to be provided to a pixel element at each of the different frame times (scans) within an image refresh cycle to thereby effectively cause that pixel element to go from one particular reflection state (associated with the old image) to another particular reflection state (associated with a new image). Thus, the recipe specifies or determines the voltages that are to be provided to a pixel element transistor during successive frame times or scans of an image refresh cycle such that a different average or effective voltage (V) is or can be supplied via the source electrode of the transistor of each pixel element in the display panel over the number of scans of the image refresh cycle. The recipe is configured to assure that the pixel element is correctly driven to a new reflection state associated with the average voltage. Typically, in most driving circuits, only three different voltages are allowed on the source electrodes of the pixel transistors, e.g., −15V (white), 0V (stay) and +15V (black). As a result, the recipe is used to create an average voltage, over time, at the transistor output that matches the desired gray level. This voltage source limitation is made to simplify the column (i.e., source) driver integrated circuits (ICs) as it can be difficult to design a driving IC that is able to provide a significant number of different voltage levels to the source electrodes of the pixel transistors. However, some bi-stable stable displays, such as EPDs, may have 4, 8, 16, etc., reflection states, and thus need an increased number of voltage states, which, as noted above, are created by the voltage averaging action of the recipe.

In order to implement the image driving methodology discussed above, EPDs typically use a double image buffer on the driving IC or chip, to update the image on the display. Such a double image buffer includes a first image buffer that stores voltage values or pointers for the voltage values (e.g., gray level, voltage level, etc.) of each of the pixel elements of the old image and a second image buffer that stores the values or pointers for voltage values for each of the pixel elements of the new image to be written to the display. Thus, the first image buffer contains the levels of the current image on the display, while the second image buffer contains the gray levels of the new image to which the display is to be driven. During operation, the two images are compared, on a pixel-by-pixel basis, by hardware on the driving IC, and the difference between the two images, on a pixel-by-pixel basis, determines the recipes that the driver IC uses to supply voltage to the source electrodes of the pixel element transistors to turn the old image into the new image. This operation is different from all other conventional displays, like liquid crystal displays (LCDs) or organic light emitting displays (OLEDs), that all have only one image buffer containing the current or new image data that is replicated on the screen at a high frequency (typically at 50 Hz). The reason for this difference is that EPDs are bi-stable (or actually multi-stable), meaning that the last image will remain on the screen even when the power is turned off. Therefore a new image always has to be created by starting with the old image and driving the image pixels in an effective manner based on the difference between the pixel state of the old image and the pixel state of the new image.

However, as noted above, this methodology requires a driving IC that has two complete image buffers, wherein each image buffer has a number of storage elements equal to the number of pixels, with each storage element having a size determined by the number of reflection states (gray levels) to which any of the pixel elements may be driven. For, example, the two state system referred to above needs a 1 bit memory for each pixel element in each of the image buffers, while a 16 gray level system needs a four bit memory (i.e., a byte of memory) for each pixel element of the display for each image buffer. Moreover, the look-up table, which may also be located on the driving IC needs to have a number of recipes equal to the square of the number of gray states.

In some cases, however, it can be more expensive (in terms of cost, complexity and size on the driving IC) to provide two complete image buffers on the driving IC. For example, driving ICs that are able to provide a significant number of different gray levels, e.g., associated with a 4, 8, 16, etc., gray level display, can be limited in space. Moreover, it is more difficult to provide memory on these ICs. As such, many simple EPD driving ICs have only have a single image frame buffer. These driving ICs are typically used in lower resolution displays, such as shelving displays that are typically used to provide electronic pricing information, product information, etc.

For driving ICs that only have a single image buffer, it is typical to drive the display in a manner that blanks or erases the entirety of the old image prior to driving the pixels elements to the gray levels associated with the new image. In other words, using these types of ICs, it is typical to use a first part of the image refresh cycle (e.g., half of the frame times or frame cycles) to drive each pixel element to a known state, called an erase state, which is typically all white or all black. The IC may use a different recipe for blanking or erasing each possible gray level value of the old image, and thus the IC may only need a number of recipes that equals the number of gray levels, e.g., four recipes for a four gray level system, 16 recipes for a 16 gray level system, etc. The image buffer may be loaded with a pointer to one of these recipes (or to a memory location within a look-up table that stores or points to one of these recipes) during the first half of the image refresh cycle, called an erase phase. Thereafter, during the second half of an image refresh cycle (called a write phase), the IC drives the pixel elements of the display from the known erase or blank state to the new gray level states as specified by the new image. Here again, the IC may use a different recipe for going from the known erase state to each of the possible gray level values of the new image (and thus the IC may again need a number of recipes that equals the number of gray levels, e.g., four recipes for a four gray level system, 16 recipes for a 16 gray level system, etc.) During this time, the image buffer may be loaded with a pointer to one of these recipes (or to a memory location within a look-up table that stores or points to one of these recipes). However, in this case, the comparison used to identify the recipe is performed in hardware on the driving IC.

While this methodology is very judicious in terms of usage of the image buffer memory, this methodology requires that the entire image be blanked or erased at the same time during each image refresh cycle. This feature provides an image refresh that can appear to be flashing, or not as smooth, as the image refresh methodology performed in systems that have two image frame buffers. Moreover, this methodology always takes between half and the full amount of the image refresh time (e.g., 600 ms) to completely refresh the display and is thus slower, on average, than systems that use a two image buffer in which, in many instances, pixel elements can be driven from the first reflective state associated with the old image to the second reflective state associated with the new image in less than half the image refresh cycle time. Again, this slower transition is more noticeable to a user. The flashing and slower changing display can, at times be noticeable to a user, and makes the image update process using a single image buffer appear to be less clean or crisp than that to that which users have become accustomed.

SUMMARY

A new bi-stable display driving technique may be used to drive an image refresh on a bi-stable display, such as an EPD, using a driving IC with a single and limited in size image buffer, in a manner the does not require a simultaneous blanking or erasing of the display and in a manner that operates to drive the pixel elements of the display to their final value associated with the new image more quickly during an image refresh cycle, thus making the image refresh of higher quality and more pleasing to the eye while still using a driving IC with limited memory.

Generally speaking, the technique determines, in the central processing unit (CPU) attached to the driving IC, a difference, on a pixel-by-pixel basis, between the gray level values of the old or current image and the gray level values of the new image to thereby define a difference matrix, and the CPU may store an indication of these pointers developed from these differences in the image buffer on the driving chip. In some cases, the difference matrix may be matrix that stores pixel value pairs defining the values of the current image pixel and a value of the new image pixel. Moreover, these difference values of the difference matrix may be encoded or developed as a number or identifier indicating one particular pair out of all of the possible pairs or combinations of old values and new values. In this case, there will be a total number of possible identifiers equaling the square of the number of gray levels used in the system. The identifier or pointer stored in the image frame buffer for each pixel may point to an address in a look-up table, that may also be located on board the driving IC. The look-up table may store, at the address pointed to by the pointer in the frame buffer, the particular recipe to be used to drive the voltage level of a pixel element for that particular difference or for that old/new pixel value pair to reach the new pixel value (reflection state) during the various scans of an image refresh cycle.

Thereafter, the timing circuitry of the driving IC uses the pointers stored in the image frame buffer to access the recipes within the look-up table to drive the transistors and, in particular, to set the voltage level of the transistor source electrode of a pixel during the successive scans of an image refresh, to drive the pixel from the old gray level (reflection state) to the new gray level (reflection state) directly, without necessarily going through a blanking or erase state. This operation provides for an image refresh that is more smooth and that takes less time, resulting in a higher quality image refresh.

DETAILED DESCRIPTION

Figure 1:
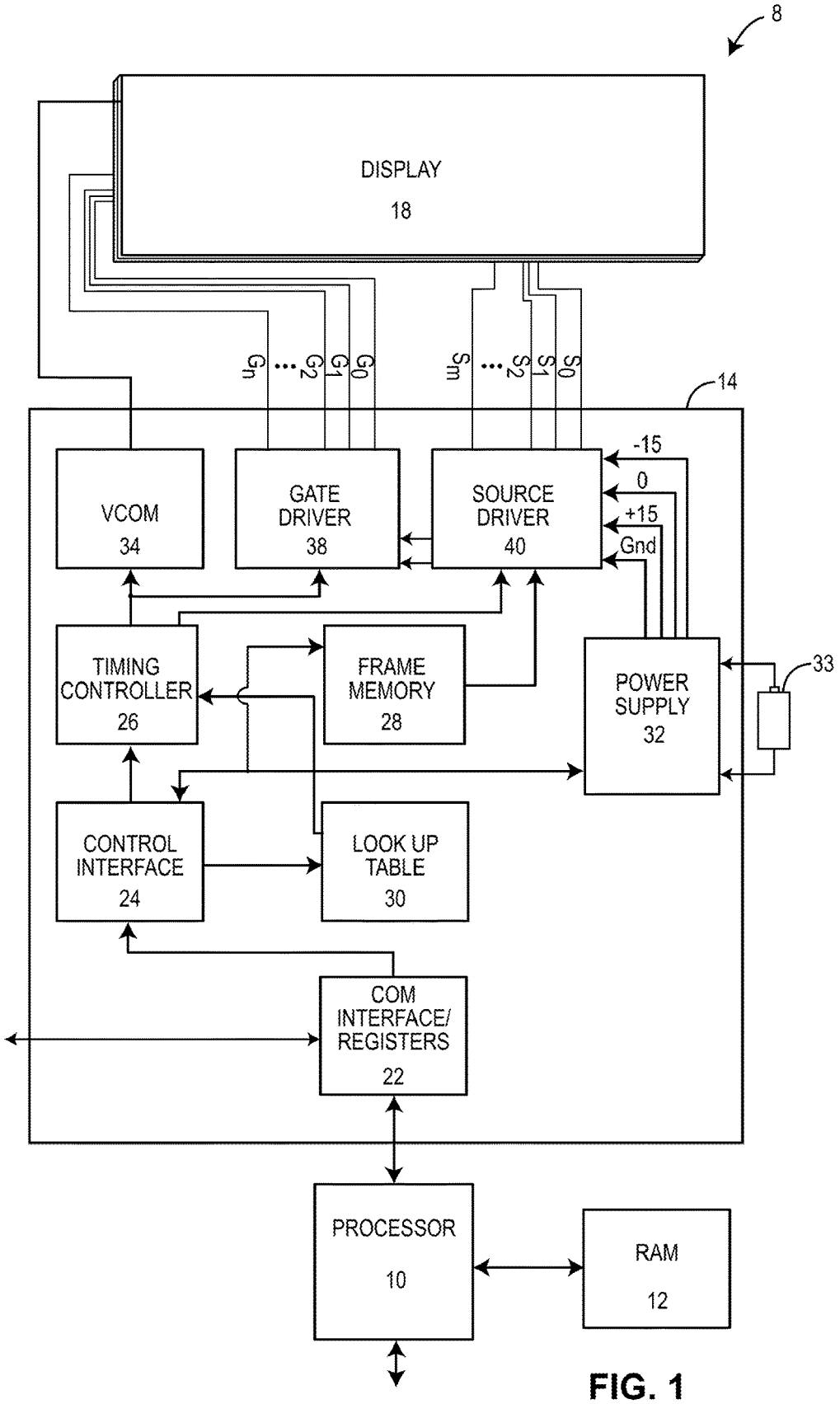
FIG. 1 illustrates a block diagram of a bi-stable display system having a driving IC with a single image buffer and a look-up table.

FIG. 1 illustrates a display system 8 associated with a bi-stable display and includes a processor 10 (e.g., a microprocessor or a CPU) coupled to a random access memory (RAM) 12 and to display driving circuit 14, also referred to herein as a driving IC 14. The driving IC 14 is, in turn, coupled to an electronic display 18 which, in this case, may be an electrophoretic display (EPD) or any other type of bi-stable display. As is known, an electrophoretic display may include multiple display layers, with a first layer being a common or ground layer, a second layer including an array of transistors for providing voltages at each of a number of the pixel elements of the display, and with a third layer disposed between the first and second layers that includes display capsules (microcapsules) that react to the voltages between the first and second layers at the pixel elements to reach one of a number of predetermined reflection states or gray levels. As is known, the average voltage at each pixel element drives the microcapsule of a pixel element of the electrophoretic display to be black or white or, in some cases, to be a level of gray between black and white. In many cases, various different levels of gray, such as 16 gray levels or 32 gray levels, can be used.

Of course, the microprocessor 10 of FIG. 1 executes instructions thereon, which may be stored as applications or as processes on the RAM 12, or which may be stored as instructions in a memory of the processor 10, or which may be stored in any other memory, for implementing display operations to be performed via the display 18 using the driving IC 14. The microprocessor 10 or CPU 10 also performs other functions such as communication functions with exterior devices, executing applications which may or may not include producing an image for the display 18, accepting user input, etc. As illustrated in FIG. 1, the display driver or driving IC 14 includes various known components, including a communications interface 22 (e.g., a serial interface and/or a register bank), and a controller interface or a controller 24 which communicates with the processor 10 via the communications interface 22 and which performs computational operations on the driving IC 14. The controller 24 is connected to a timing controller 26, to a frame buffer memory 28 (also called an image frame buffer) and to a look-up table 30, as well as to a power circuit 32, which provides power to the other components of the circuit 14 as well as to the components of the display 18 used to drive the display 18. The timing controller 26, which controls the timing of the various signals used to drive the pixel elements of the display 18, communicates with a common voltage circuit 34, with a gate driver circuit 38 and with a source driver circuit 40 which provide signals to the various layers of the display 18 to drive the pixel elements of the display 18 to form an image on the display 18. In particular, the timing controller 26 uses information (in the form of recipes) stored in the look-up table 30 to drive the various layers of the display 18 to create an image that is to be formed on the display 18. More particularly, the timing controller 26 causes the common voltage circuit 34 to provide a common voltage (Vcom) to a first layer of the display 18, and drives the gate driver circuit 38 and the source driver circuit 40 to establish voltages at each of the pixel elements in the display 18 in a manner that causes these pixel elements to reach and stay at a desired gray level. In particular, the gate driver circuit 38 provides a turn-on voltage to each of the gate electrodes of each of the transistors within a row of the display 18 via one of the gate lines ($G_0$-$G_n$), on a row-by-row basis. Likewise, the source driver circuit 40 provides a voltage (e.g., −15 volts, +15 volts, 0 volts) to the source electrodes of the transistors via one of the source lines $S_0$-$S_m$) in each of the columns of the display 18. The timing controller 26 operates to control the precise timing of the gate driver circuit 38 and the source driver circuit 40 to cause a new voltage, as specified by the recipe for a pixel, to be provided to the source electrode of the transistor of the pixel (while the gate electrode for that transistor has a turn-on voltage provided thereto) during each frame time or scan of the display and thus causes the pixel element to change between reflection states (gray levels) during each image refresh cycle.

As indicated in FIG. 1, the source driver circuit 40 is connected to and receives power from the power supply 32, which may be connected to an external power source, such as a battery 33, within the device 8. In any event, the timing controller 26, in response to the chip controller 24, controls the timing of the image refresh operations performed on the display 18. Generally speaking, the timing controller 26 will control the display 18 to refresh at an image refresh rate which may be, for example, 600 milliseconds, and may do so by implementing, for example, 30 frame refresh cycles or scans during each image refresh cycle. Here, a frame refresh cycle may takes 20 milliseconds (50 Hz). During each frame cycle, the timing controller 26 refreshes each of the rows of pixels driven by the gate driver circuit 38 once, while setting the voltages at each of the source electrodes for the transistors at each of these pixels (i.e., for the columns in the row that is currently turned-on) according to that specified by the recipes for those pixels. In this manner, the gate driver circuit 38 is timed in conjunction with the source driver circuit 40 to refresh the display 18 so that the timing controller 26, under the control of the control interface 24, refreshes the display 18 during each frame scan according to the voltages specified by the recipes in the look-up table 30. Importantly, in this case, the timing activities are all performed on the driving IC 14 and, in particular, by the control interface 24 and the timing controller 26, to assure that the display 18 is always being driven properly. In this case, the CPU 10 does not have to perform the very expensive display driving operations and thus does not have to have increased power or capability to be able to do so. As a result, the CPU 10 does not need to be as expensive (in computational power and cost) and importantly, does not need to draw as much power from a battery.

As noted above, driving ICs which only have a single frame buffer, such as the driving IC 14 of FIG. 1, drive each of the pixel elements of the display 18 to an erase state during a first phase of the image refresh cycle (an erase phase) using a first recipe stored in the look-up table 30, and drive the pixel elements of the display 18 to the final reflection state (gray level) associated with the new image during a second phase of the image refresh cycle (a write phase) using a second recipe stored in the look-up table 30.

Typically, the controller interface 24 writes all of the possible recipes for each of the phases in the look-up table 30 at the beginning of each phase, and performs the comparisons, on a pixel-by-pixel basis, needed to define the correct recipe during each phase for each of the pixel elements. In this case, the comparison is performed between the old image values stored in the image frame buffer and the erase state during the erase phase and between the new image values stored in the image frame buffer and the erase state during the write phase. This feature provides a computational load on the controller 24 and, more importantly, results in the image refresh cycle being divided into the two phases (the erase phase and the write phase), which leads to the poor image refresh quality problems discussed above.

A new driving methodology described herein performs the old/new image comparison computations directly, on a pixel-by-pixel basis, in the CPU 10 (instead of on the driving IC 14). In one case, the CPU 10 performs the comparison to identify a difference between the current pixel value or gray level of a pixel (i.e., associated with the current or old image) and the new pixel value or gray level of the same pixel (i.e., associated with the new image to be written to the display 18) to produce an identifier that identifies one of a finite set of gray level pairs (old to new). A different recipe may be used for each such identifier or possible pair. The CPU 10 performs this comparison for each pixel in the image to produce a difference matrix that has an element associated with each pixel in the image. The results of the comparison are then used to create pointers that are stored into the frame image buffer 28 on the driving IC 14 while the recipes are stored in the look-up table 30 on the driving IC 14. If desired, pointers to the recipes may instead be stored in the look-up table 30 that point to a position in RAM 12 that stores the recipe itself. Thereafter, during the image refresh cycle, the controller 24 may simply use the recipe, as stored in the look-up table 30, that is defined or identified for a pixel within the image frame buffer 28 for each pixel, to thereby control the source driver circuit 40 to provide the appropriate voltage level to the source electrodes of the transistors of the pixels elements in the display 18. In this manner, the part of the computational power needed to perform the pixel-by-pixel comparison is performed in the CPU 10 (instead of on the driving IC 14) which reduces the processing power requirement of the controller 24. However, as this comparison only needs to be performed once per image refresh, or at most a limited number of times during an image refresh cycle, this computation does not put any or much additional requirements on the CPU 10 over and above those that the CPU 10 already must satisfy, as this comparison step is not very sensitive to the display 18 timing schedule associated with the frame scans. Moreover, the CPU 10 may convert the elements of the difference matrix into pointers to (e.g., addresses of) the look-up table 30 to define for the controller 24 which recipe to use to update each pixel in the image during a particular refresh cycle.

More particularly, during operation, the CPU 10 compares the current image or pixel value at each pixel of the display 18 to the new image or pixel value at each pixel of the display, and creates a difference chart (matrix) that defines the gray level changes between the old image and the new image. In one case, in which there are 16 gray levels, the differences may be written as a two-byte value pointing to an address within the look-up table 30, with the first bite being a row of the look-up table 40 and the second byte being a column of the look-up table 30. These addresses may then be written to the frame buffer memory 28 for use in defining how each pixel element associated with each location of the frame buffer memory 28 is to be changed or driven during a particular refresh cycle. Here, the first byte indicates the old image gray level value, and the second byte indicates the new image gray level value. Of course, the look-up table memory location defined by any particular image frame buffer value stores a recipe (or a pointer to a recipe) to be used to drive the pixel element associated with the image frame buffer location from the old gray level to the new gray level during the successive frame scans of an image refresh cycle. In this manner, the image frame buffer 28 may store a pointer to a look-up table address value (wherein each address value combines a row pointer, which may be indicative of the old gray level value, with a column pointer, which may be indicative of the new gray level value), and the pointer may point to, or identify a recipe stored in the look-up table 30 that defines how to set the voltages of a pixel element transistor during each of the frame scans of an image refresh cycle to go between those two levels. In another case, the CPU 10 may encode each identified pair (old pixel value/new pixel value) as a unique number or identifier (e.g., 0-255 for a system having 16 gray levels) and store the unique identifier in the frame memory or image frame buffer 28. This unique identifier will then point to a particular location or address within the look-up table 30 at which the recipe for this old/new gray level pair will be stored. This encoding step may limit or reduce the memory size that is needed for each location of the frame buffer 28. In any event, this image refresh operation allows the controller 24 to drive the display 18 from the current pixel values (associated with a current or old image) directly to the new pixel values (associated with a new image to be written to the display 18) without having to go through an erase or a blanking state first. This operation thereby makes for a smoother transition in the display, as well as provides for a faster image refresh.

Figure 2:
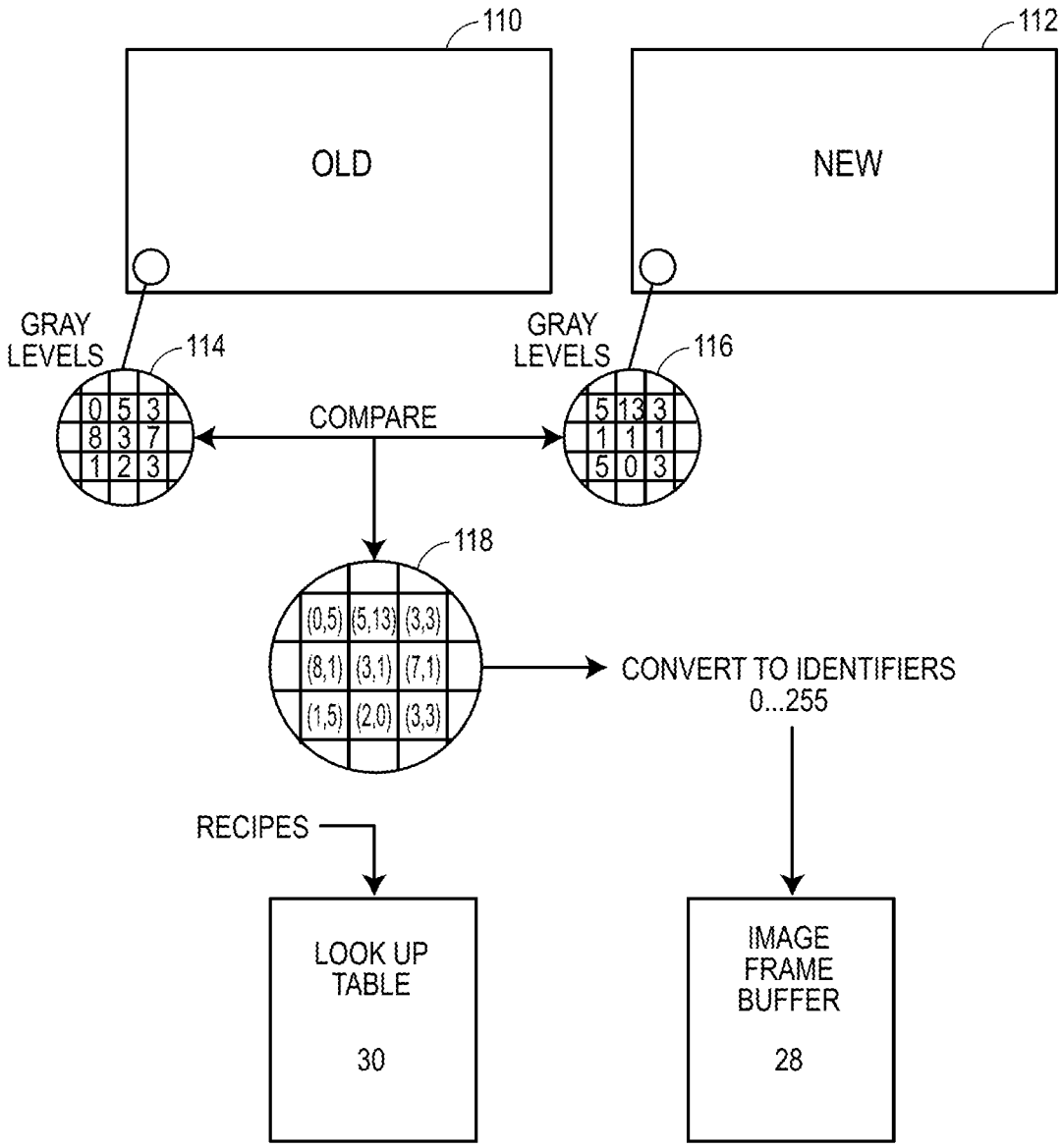
FIG. 2 illustrates a schematic diagram of a method of performing an image refresh on the bi-stable display system of FIG. 1.

FIG. 2 schematically illustrates one methodology of performing this image refresh operation using the system of FIG. 1. In particular, FIG. 2 illustrates a schematic view of a memory (which may be part of the RAM 12 of FIG. 1) that stores the pixel values (e.g., the gray levels) of an old or current image 110 (being displayed on the display 18) and a new image 112 to be displayed on the display 18. A blow up of the same portion of each display 110 or 112 is illustrated in detail in bubbles 114 and 116, respectively, below the displays 110 and 112 to depict the actual gray level values for the same nine pixels in these displays. During the process of updating an image display, the CPU 10, which is not on the driving IC 14, compares the old gray level values 114 with the new gray level values 116 to create a comparison chart or difference matrix, such as that illustrated in a bubble 118 in FIG. 2. In this case, the bubble 118 defines, for each pixel in the image, both an old gray level value and a new gray level value, defining the gray level transition that is to be implemented during a particular image refresh cycle. Each gray level transition defines, in this case, one of a limited set of transition pairs. In particular, in a display system that uses 16 gray levels, there will be $16^2$ (i.e., 256) possible transition pairs. It is generally the case that there will be a number of transition pairs equal to the square of the number of gray levels. In any event, CPU 10 may encode or convert each transition pair determined during the compare process to one of a set of unique numbers or identifiers (in this case ranging from 0-255) and may store that as a difference matrix if so desired. As indicated on the right-hand bottom side of FIG. 2, the CPU 10 may store the determined identifier for each pixel in the image frame buffer 28 as a pointer to a location in the look-up memory 30 at which the recipe to be used for driving that pixel is stored. Moreover, as indicated on the left-hand bottom side of FIG. 2, the CPU may store a different recipe for each of these identifiers at the associated memory locations within the look-up table 30. As a result, the frame image buffer 28 points to an address within the look-up table 30 at which a recipe is stored, wherein this recipe defines the manner in which the controller 24 should drive the pixel during the image refresh cycle to thereby drive the pixel directly from the old pixel value to the new pixel value. The frame buffer 28 thus stores, for each pixel of the display 18, a pointer to a location in the look-up table 30 that indicates the trajectory or path (i.e., that defines the recipe) to be used to update that pixel during each frame cycle of an image refresh cycle to drive the display from the old image to the new image.

Using this methodology, the driving IC 14 can store, within the image frame buffer 28, a single value during the entire image refresh cycle, which value points to a single recipe that defines the voltage sequence to be provided to the source electrode input of the transistor for that pixel during each frame scan of the image refresh cycle. This feature, in turn, uniquely drives a pixel in the display from an old pixel gray level to a new pixel gray level, without necessarily driving all of the pixel values to an erase state first. This methodology thus enables a full image update without the use of an erase phase (wherein each of the pixels is simultaneously at an erase state). This methodology also enables the use of a driving IC with a single image frame buffer to refresh an EPD in a manner that appears cleaner (with no or less blanking), and in a manner that is faster, while also off-loading some processing power to the CPU (i.e., away from the driving IC controller).

As will be understood, this methodology requires an image frame buffer that is able to store a byte sized (8-bits) pointer to the look-up table 30, in a display system that uses 16 gray levels. Thus, in this case, the image frame buffer 28 needs to have a byte worth of storage for each pixel of the display 18. Moreover, this system requires a look-up table 30 that can store a number of recipes equal the square of number of gray levels. However, in many cases, the driving IC 14 may not include a frame buffer or a look-up table that includes that much memory space. It is, however, possible to reduce size of the image frame buffer 28 and the size of the look-up table 30 (to, for example, less than a byte for a 16 gray level display) by driving each pixel of the display to a new value in various phases, such as in two phases, three phases, etc. In this case, the CPU 10 may define a new difference value for each pixel in the display at each phase and may reload a new look-up table pointer in the image frame buffer 28 and a new set of recipes into the look-up table 30 at the beginning of each phase. In another case, the different sets of recipes for each phase of a refresh cycle may be stored in separate or separately addressable look-up tables or look-up table sections on the driving IC 14, for example, to reduce the need to reload a particular look-up table during the refresh cycle. In this case, the separate or separately addressable look-up tables on the driving IC 14 are considered to be "a look-up table" as used herein. Here, the frame buffer memory 28 may be reloaded with new pointers (to a new look-up table section) for each phase, or may use the same pointers, but the controller 26 may access the recipes from a different look-up table or look-up table section during each different phase. This latter technique reduces the need to reload the frame buffer memory 28 during a particular refresh cycle having multiple phases. For example, the CPU 10 may, at a first phase, develop a comparison chart or difference matrix (and define an associated set of recipes) that drives the pixel values from the old image to one of a limited number of intermediate gray levels, for example, to one of four intermediate gray levels of the 16 possible gray levels. Then, during the next phase, the CPU 10 may develop a new comparison chart or difference matrix (and an associated set of recipes) associated with driving the values of each of the pixel elements from one of the limited number of intermediate of gray levels to any of the possible final gray levels and may store these pointers and recipes in the image frame buffer 28 and the look-up table 30, respectively. While this methodology will result in a slower image refresh, as long it uses two or more phases, this methodology does not result in a simultaneous blanking or erase of the display (as the pixels of the display will still take one of two, four, eight, etc., intermediate levels in a pseudo-random manner, at the end of the first phase). However this methodology will reduce the memory size needed for both the image frame buffer 28 and the look-up table 30 by reducing the number of possible transition pairs used at each phase (and thus the size of the identifier needed to be stored in the image frame buffer 28 and the number or recipes needed to be stored in the look-up table 30).

Still further, this multi-phase methodology can be extended to any number of phases and to any number of intermediate gray levels. Thus, for example, an image pixel can be driven from an old image value to a new image value by being driven, during a first phase, from its current value to one of a limited number of intermediate gray levels, being driven, during a second phase, from one of the limited number of intermediate gray levels to another of a set of intermediate gray levels, and being driven, in a third phase, from one of the another set of intermediate gray levels to any of the possible final gray level values. Here, each subsequent intermediate gray-level value through which a pixel element passes will presumably be closer to the final gray-level value for that pixel. In any case, in each of these situations, each of the pixel values of the image does not reach an erase state simultaneously, and thus presents a more crisp or cleaner display update. Moreover, if desired, the CPU 10 may compute a separate difference matrix to define the pixel transitions in each phase and the controller 24 may store new pointers in the frame buffer memory 28 and may store new recipes (if desired) in the look-up table during each phase.

In a still further case, the CPU 10 may perform a comparison from the old gray level to the new gray level values to define a comparison chart such as that described above and illustrated in, for example, FIG. 2, i.e., one that defines a transition directly from the old gray level value to the new gray level value. In this case, the CPU 10 may also store (e.g., in the RAM 12) a unique recipe for each possible transition pair. However, in this case, the recipes may be implemented in multiple phases (e.g., two, three, four phases). Moreover, each of the recipes may be defined so that each recipe includes a number of recipe fragments, with one recipe fragment being used for each phase for a particular pixel. However, the recipes may be defined such that, during any particular phase of the image refresh cycle, there are only a limited number of recipe fragments that are used in the system. For example, while, in a 16 gray level system, there will be 255 recipes (associated with going from each one of the 16 possible gray levels to another of the 16 possible gray levels), the recipes may be defined using a limited number of recipe fragments (e.g., four recipe fragments) during any particular phase. That is, the recipes may be defined such that each recipe includes one of four possible recipe fragments during any particular phase. It would be possible to change the makeup of the recipe fragments from phase to phase so long as only a limited number of recipe fragments are used in each phase. For example, a first recipe fragment may define a set of source voltages to be used during the successive scans of a particular phase of an image refresh cycle to cause a fast positive change in the average voltage level at the pixel (e.g., +15, +15, 0, +15), a second recipe fragment may define a set of source voltages to be used during the successive scans of the particular phase of an image refresh cycle to cause a slow positive change in the average voltage level at the pixel (e.g., 0, +15, 0, 0), a third recipe fragment may define a set of source voltages to be used during the successive scans of a particular phase of an image refresh cycle to cause a fast negative change in the average voltage level at the pixel (e.g., −15, −15, 0, −15), and a fourth recipe fragment may define a set of source voltages to be used during the successive scans of a particular phase of an image refresh cycle to cause a slow negative change in the average voltage level at the pixel (e.g., 0, −15, 0, 0). A different limited set of recipe fragments may be used during the second phase of the image refresh cycle and a still different set of limited number of recipe fragments may be used during a third phase of the image refresh cycle. It is considered that the limited number of recipe fragments allowed in the earlier phases of an image refresh cycle will tend to provide for faster voltage changes to enable quick movement of the image voltage during the initial phases of the image refresh cycle and that the limited number of recipe fragments used in the recipes of the later phases of the image refresh cycle will tend to have finer voltage movements to enable particular specific gray levels to be reached in the later phases of the image refresh cycle. This methodology will work to reduce the size of the image frame buffer 28 (as the pointers that the CPU 10 stores therein during each phase of the image refresh cycle will only need to point to one of a limited number of recipe fragments) and will reduce the size of the look-up table 30, as the CPU 10 only needs to store a limited number of recipe fragments in the look-up table 30 during each phase of the image refresh cycle. However, the combination of recipe fragments used for any particular pixel over the various phases can be selected to assure that a pixel goes directly from the old image gray level to the new image gray level. That is, a unique combination of the limited number of recipe fragments may be used for a particular pixel to drive that pixel between a first one of any of the possible gray levels to a second one of any one of the possible gray levels.

In any event, using one or more of the techniques described above, EPD or other bi-stable display driver ICs can be used that combine gate, source and display controller features into one IC while including only a single image frame buffer and a single look-up table, with limited memory space. These techniques are particularly useful for devices with small form factors and for low cost products where IC size and component size is important. Moreover, these techniques are useful with driver ICs with only a single image frame buffer and only a limited amount of on-chip memory space, which are the types of ICs that are readily available using CMOS technology, which is a high-voltage technology needed for the gate drivers (and to a certain extent the source drivers) of the IC portion of the integrated component of EPDs, as the cost to add more complex functions in the IC that uses this high-voltage technology is higher and does not permit the use of a double image buffer.

It should be noted that, while the image driving technique described herein is described with reference to changing pixels of a bi-stable electronic display between different gray-level values (i.e., different gray-level image values), the technique could additionally or alternatively be used to drive a color bi-stable electronic display by changing pixels of such a bi-stable electronic display between different color values (i.e., different color level image values). Such different color image values could define different colors (e.g., a different combination of red, green and blue, for example) or could define different levels of a single color (e.g., different brightness or amount of blue, for example).

In some cases, each image pixel of a "color" bi-stable display may have separate image components (e.g., particles or media) that effect or control the gray level of a pixel (i.e., the black/white image value) and that effect or control one or more color levels of the pixel (e.g., red or blue or green). In these cases, a different recipe may be stored and used to drive each such image component of a pixel during a particular refresh cycle. That is, a first recipe may be used to drive the black/white image component of a pixel during a refresh cycle to drive the pixel from one gray level to another gray level and a second recipe may be used to drive a color image component (e.g. red) of the same pixel from one "red" level to a second "red" level. These recipes may be stored separately in the image look-up table 30 on the driving IC 14 and may have different pointers thereto stored in the image frame buffer 28 (also referred to herein as a frame buffer memory) during a particular refresh cycle. If desired, the different sets of recipes for different image components could be stored in separate look-up tables on the driving IC 14 or in the same look-up table that has separately addressable regions for these different types of recipes. In any case, the separate look-up tables may be considered "a look-up" table, as used herein. Likewise, the driving IC 14 may have a frame buffer 28 that has two or more memory locations for each pixel, with a pointer to the different sets of recipes (e.g., to a black/white recipe and to a color recipe) being stored in the different memory locations for each pixel. Of course, the frame buffer 28 may be divided into separate and distinct frame buffer sections that are separately addressable, but that make up a common "frame buffer memory" as used herein. In any event, in this case two different recipes may be used simultaneously during an image refresh cycle to drive the different image components of a single pixel. The CPU 10 may additionally compute or determine a separate difference matrix for each of the image components and may develop a separate set of recipe pointers for storage in the frame buffer memory 28 from each of these difference matrixes. Of course, any number of image or color components and separate set of recipes therefor could be used to control a color display, with any number of look-up table and frame buffer memory components being placed on the driving IC 14 to support the manipulation of these image or color components.

On the other hand, a single recipe may be stored for a pixel that effects or defines the manner in which the different image components of a color pixel may be driven. For example, a certain set of voltages may be used to drive a first image component (such as +15, 0, and −15 volts being used to drive the black/white image component to produce a gray level for the pixel) and a second set of voltages may be used to drive a second image component (such as +3, 0, and −3 volts being used to drive a color image component, such as red). In this case the same recipe may effect both image components of a pixel by varying between these different voltage levels at different times during a refresh cycle. If desired, a recipe may have different phases to be instituted at different times during an image refresh cycle, with a first phase used to define and drive movement of one of the image components (e.g., the black/white image component) and a second phase used to define and drive movement of a second one of the image components (e.g., the color image component, such as the red image component). In one particular example which uses different levels of voltages to drive the different image components, the recipe could have a first phase made up of a series of voltage levels to drive a black/white component (e.g., +15, 0, +15, −15, +15) and may have a second phase made up of a series of second voltage levels to drive a color component (e.g., −3, −3, +3, 0, +3). These first and second phases of the recipe may be instituted at different times of a refresh cycle.

Still further, while the description of the driving technique provided herein assumes that the difference matrix will be established by the processor 10 of FIG. 1 as a difference matrix defining a difference between a current image being displayed on the image display and a new image to be displayed on the image display, and then defining on a pixel-by-pixel basis a recipe to effect that change or difference, the processor 10 may define a difference matrix taking into account multiple previous images on the display (which may or may not include the current image on the display). In some cases, such as in high quality electrophoretic displays, it can be beneficial to use a recipe that is tailored to change a pixel value of a current display to a new value taking into account one or more previous values of that pixel in previously displayed images. For example, instead of performing a comparison to create a difference matrix having an image level pair with exactly two values (with a first member of the pair defining an image value for a particular pixel of the current image and with a second member of the pair defining an image value for the particular pixel of the new image), the processor 10 could perform a comparison between each pixel value of the new image and the pixel values for the same pixel in two or more previous images (with the current image being considered a potential previous or previously displayed image). In the case in which the comparison is performed with two previous images including the current image and the image immediately preceding the current image, each element of the difference matrix could include a triplet with one value of the triplet associated with the immediately preceding image, one value of the triplet associated with the current image and one value of the triplet associated with the new image. This triplet can then be used to define a recipe to be used to drive the associated pixel of the current image to the new image value, given the value of that pixel in the immediately preceding image. Of course, other manners of defining a difference matrix based on multiple previous images could be used as well. Still further, any number of previous images can be used to define pixel driving recipes in this manner (with the number of recipes generally increasing with an increase in the number of previous image values being considered).

Although the forgoing text sets forth a detailed description of numerous different embodiments of the invention, it should be understood that the scope of the invention may be defined by the words of the claims set forth at the end of this patent and their equivalents. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention. Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

The invention claimed is:

1. An electronic display device, comprising:

a processor;

a computer readable memory coupled to the processor;

a bi-stable electronic display having a set of pixels defining an image area; and a driving integrated circuit coupled between the processor and the bi-stable electronic display to drive the bi-stable electronic display, the driving integrated circuit including a frame buffer memory having a memory location for each of the set of pixels of the bi-stable electronic display, a look-up table, and a controller which is coupled to the processor;

wherein the computer readable memory stores instructions that, when executed on the processor, causes the processor to compare, on a pixel-by-pixel basis, pixel values for a previously displayed image displayed on the bi-stable electronic display and pixel values for a new image to be displayed on the bi-stable electronic display to produce a difference matrix;

wherein the look-up table stores information defining a set of recipes, each recipe adapted to be used by the driving integrated circuit to drive a pixel of the bi-stable electronic display from a first image level to a second image level during a refresh cycle of the bi-stable electronic display; and wherein the controller operates during a refresh cycle of the bi-stable electronic display to store, in the frame buffer memory, a set of pointers developed from the difference matrix, wherein the pointer at each different memory location of the frame buffer memory points to one of a set of memory locations in the look-up table to define a recipe to be used during the frame refresh cycle to change a pixel from a first image level to a second image levels associated with the new image.

2. The electronic display device of claim 1, wherein the difference matrix defines an image level pair for each of the set of pixels, with an image level pair defined for each element of the difference matrix, each image level pair including a first image level associated with a previously displayed image and a second image level associated the new image, and wherein the controller stores, in the frame buffer memory, a pointer to an address of the look-up table at each location of the frame buffer memory based on the image level pair of an associated element of the difference matrix.

3. The electronic display device of claim 2, wherein the processor converts an image level pair for each of the elements of the difference matrix to a number that uniquely identifies an image level pair as one of a possible set of image level pairs, and wherein the controller stores the numbers for the different elements of the difference matrix in the frame buffer memory as pointers to addresses of the look-up table.

4. The electronic display device of claim 2, wherein the controller stores an image level pair at each location of the frame buffer memory as a pointer to an address in the look-up table.

5. The electronic display device of claim 1, wherein the bi-stable electronic display include an electronic switch at each of the set of pixels, the electronic switches operable to provide one of a set of different voltages at the each of the set of pixels at a given time, wherein each recipe defines a set of voltages to be applied at a pixel in sequence during a refresh cycle by the electronic switch at the pixel, wherein the driving integrated circuit includes one or more drivers coupled to the electronic switches and a timing controller that controls the operation of the one or more drivers to cause voltages as defined by the recipes to be applied in sequence at the pixels by the electronic switches during a refresh cycle.

6. The electronic display device of claim 1, wherein the bi-stable electronic display is an electrophoretic display.

7. The electronic display device of claim 1, wherein the bi-stable electronic display includes a set of pixels that can each be driven to four or more gray level image values.

8. The electronic display device of claim 1, wherein the bi-stable electronic display includes a set of pixels that can each be driven to different ones of a multiplicity of color image values.

9. The electronic display device of claim 1, wherein the bi-stable electronic display includes a set of pixels that each includes a first image component and a second image component, wherein each of the first image component and the second image component can be driven separately to different image levels.

10. The electronic display device of claim 9, wherein the first image component is a black/white image component that can be driven to any of a plurality of gray level image values and wherein the second image component is a color image component that can be driven to any of a multiplicity of color image values.

11. The electronic display device of claim 9, wherein the processor executes to define a first difference matrix for driving changes in the first image components and to define a second difference matrix for driving changes in the second image components.

12. The electronic display device of claim 9, wherein the look-up table stores a first set of recipes for driving the first image components of the electronic display and stores a second set of recipes for driving the second image components of the electronic display.

13. The electronic display device of claim 1, wherein the processor operates to perform the pixel comparison to produce two or more difference matrixes to be used during a particular refresh cycle, and wherein the controller stores, in the frame buffer memory, a different set of pointers to the look-up table, during the particular refresh cycle, wherein the different sets of pointers are based on different ones of the two or more difference matrixes.

14. The electronic display device of claim 13, wherein the processor operates to produce a first difference matrix by performing a first pixel comparison to transition each pixel value of a current image to one of a set of intermediate pixel values and the processor operates to produce a second difference matrix by performing a second pixel comparison to transition each pixel value from one of a set of intermediate pixel values to a new image value.

15. The electronic display device of claim 14, wherein the processor operates to produce a third difference matrix by performing a third pixel comparison to transition each pixel value from one of a first set of intermediate pixels values to one of a second set of intermediate pixel values.

16. The electronic display device of claim 1, wherein the processor operates to select a recipe for each of the set of pixels based on a corresponding element of the difference matrix, wherein each selected recipe is a set of two or more recipe fragments, wherein the look-up table stores information defining the set of recipe fragments, and wherein the controller stores, in the frame buffer memory, for a particular image pixel, a pointer to a first location in the look-up table defining a first recipe fragment of the set of recipe fragments for use during a first phase of the refresh cycle and stores, in the frame buffer memory, for the particular image pixel, a pointer to a second location in the look-up table defining a second recipe fragment of the set of recipe fragments for use during a second phase of the refresh cycle.

17. The electronic display device of claim 1, wherein the processor operates to compare, on a pixel-by-pixel basis, pixel values for a multiplicity of previously displayed images displayed on the bi-stable electronic display with a pixel value for a new image to be displayed on the bi-stable electronic display to produce the difference matrix.

18. The electronic display device of claim 17, wherein the multiplicity of previously displayed images includes the currently displayed image and an image displayed on the image display at some time prior to the currently displayed image.

19. The electronic display device of claim 1, wherein the processor operates to create the difference matrix so that each element of the difference matrix defines a particular recipe to be used to drive an image pixel from a first image level associated the currently displayed image to the second image level associated with the new image.

* * * * *